US010820773B2

(12) United States Patent
Stehl

(10) Patent No.: US 10,820,773 B2
(45) Date of Patent: Nov. 3, 2020

(54) WET CLEANING DEVICE HAVING A CLEANING ROLLER MOUNTED ROTATABLY ABOUT A ROLLER AXIS

(71) Applicant: Vorwerk & Co. Interholding GmbH, Wuppertal (DE)

(72) Inventor: Christian Stehl, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 77 days.

(21) Appl. No.: 16/312,466

(22) PCT Filed: Jun. 13, 2017

(86) PCT No.: PCT/EP2017/064365
§ 371 (c)(1),
(2) Date: Dec. 21, 2018

(87) PCT Pub. No.: WO2018/001718
PCT Pub. Date: Jan. 4, 2018

(65) Prior Publication Data

US 2019/0125158 A1 May 2, 2019

(30) Foreign Application Priority Data

Jun. 28, 2016 (DE) ..... 10 2016 111 809

(51) Int. Cl.
*A47L 13/22* (2006.01)
*A47L 11/08* (2006.01)
(Continued)

(52) U.S. Cl.
CPC ..... *A47L 13/22* (2013.01); *A47L 11/085* (2013.01); *A47L 11/185* (2013.01);
(Continued)

(58) Field of Classification Search
CPC ..... A47L 11/292; A47L 11/4088; A47L 11/4044; A47L 11/4083; A47L 11/4069;
(Continued)

(56) References Cited

U.S. PATENT DOCUMENTS 1,536,687 A 5/1925 Oatey
1,783,205 A * 12/1930 White ..... A47L 9/04 15/392

(Continued)

FOREIGN PATENT DOCUMENTS

DE 102 29 611 B3 1/2004
DE 20 2009 013 434 U1 12/2009

(Continued)

OTHER PUBLICATIONS

International Search Report of PCT/EP2017/064359, dated Sep. 5, 2017.

(Continued)

*Primary Examiner* — Robert J Scruggs
(74) *Attorney, Agent, or Firm* — Collard & Roe, P.C.

(57) ABSTRACT

A wet cleaning device, in particular a wet mop, has a cleaning roller mounted rotatably about a roller axis and a roller cover surrounding, at least in part, the cleaning roller in the circumferential direction, which roller cover has at least one movable cover element for elective sealing and/or exposing of an opening region of the roller cover. In order to enable a changeover of the wet cleaning device from a wiping operation to a regeneration operation in a particularly convenient and time-saving manner, according to the invention, the wet cleaning device has a first cover element and a second cover element which, based on a circumferential direction of the cleaning roller, can be moved in opposition to each other in order to seal and/or to expose the opening region from opposite circumferential directions.

9 Claims, 6 Drawing Sheets

(51) Int. Cl.
*A47L 11/18* (2006.01)
*A47L 11/40* (2006.01)

(52) U.S. Cl.
CPC ..... *A47L 11/4041* (2013.01); *A47L 11/4088* (2013.01); *A47L 11/4069* (2013.01); *A47L 11/4075* (2013.01)

(58) Field of Classification Search
CPC ..... A47L 11/4038; A47L 11/4075; A47L 11/4041; A47L 11/4058; A47L 13/22; A47L 11/085; A47L 11/185; A47L 11/08
See application file for complete search history.

(56) References Cited

U.S. PATENT DOCUMENTS 4,875,246 A 10/1989 MacGregor
5,657,504 A 8/1997 Khoury
9,289,105 B2 3/2016 Moes
9,775,477 B2 * 10/2017 Eriksson ..... A47L 9/0411
2004/0154123 A1 * 8/2004 Christopher ..... A47L 11/4058 15/320
2007/0011838 A1 1/2007 Davis et al.
2008/0086838 A1 * 4/2008 Yoo ..... A47L 9/0488 15/415.1

FOREIGN PATENT DOCUMENTS

DE 10 2014 119 188 A1 6/2016
EP 0 898 924 A1 3/1999

OTHER PUBLICATIONS

International Search Report of PCT/EP2017/064748, dated Sep. 22, 2017.
International Search Report of PCT/EP2017/064357, dated Oct. 16, 2017.
International Search Report of PCT/EP2017/064365, dated Sep. 20, 2017.
International Search Report of PCT/EP2017/064745, dated Sep. 20, 2017.

* cited by examiner 27
26
1
23
25
24
2
3

WET CLEANING DEVICE HAVING A CLEANING ROLLER MOUNTED ROTATABLY ABOUT A ROLLER AXIS

CROSS REFERENCE TO RELATED APPLICATIONS

This application is the National Stage of PCT/EP2017/064365 filed on Jun. 13, 2017, which claims priority under 35 U.S.C. § 119 of German Application No. 10 2016 111 809.5 filed on Jun. 28, 2016, the disclosures of which are incorporated by reference. The international application under PCT article 21(2) was not published in English.

AREA OF TECHNOLOGY

The invention relates to a wet-cleaning device, in particular to a wet wiping device, with a cleaning roller mounted rotatably around a roller axis and a roller cover enveloping the cleaning roller at least partially in the circumferential direction, which has at least one displaceable cover element for optionally closing and/or releasing an opening region of the roller cover.

The invention further relates to a method for operating a wet-cleaning device, wherein a rotatable cleaning roller for a regeneration operation of the cleaning roller is displaced away from a surface to be cleaned, and wherein at least one displaceable cover element is displaced in an opening region of a roller cover that at least partially envelops the cleaning roller in a circumferential direction.

PRIOR ART

Wet-cleaning devices or methods for operating a wet-cleaning device are known in prior art.

For example, DE 102 29 611 B3 discloses a wet-cleaning device with a wiping body that can be driven so as to rotate around a rotational axis, in which a cleaning liquid is removed from a supply tank and sprayed onto the surface of the wiping body. The wiping body moistened in this way is guided over a surface to be cleaned during a wiping operation, wherein the wiping body picks up dirt from the surface to be cleaned.

During the wiping operation, the wiping body is increasingly covered with dirt, thus necessitating a regeneration. To this end, the wiping body is lifted from the surface to be cleaned, enveloped by a housing that can be telescoped in the circumferential direction of the wiping body, and sprayed with unused cleaning liquid. The wiping body rotates, so that cleaning liquid and dirt are driven out of the wiping body, hit the interior side of the housing, and are transferred into a receiving tank.

A user of the wet-cleaning device manually lifts the wiping body from the surface to be cleaned for a regeneration operation. In like manner, the telescoping housing is manually guided around the wiping body. This is uncomfortable, since the user must perform a plurality of hand displacements, which require a considerable period of time before the roller cover has been completely closed and the regeneration operation can begin.

SUMMARY OF THE INVENTION

Therefore, the object of the invention is to provide a wet-cleaning device which enables an especially comfortable and time-saving changeover from a wiping operation into a regeneration operation.

In order to achieve the aforementioned object, it is initially proposed that the wet-cleaning device have a first cover element and a second cover element, which can be displaced in opposition to each other in relation to a circumferential direction of the cleaning roller, so as to close and/or release the opening region from opposite circumferential directions. As opposed to prior art, it is thus possible to close or release the opening region from two different directions simultaneously, so that less time is required for completely opening/closing than in prior art. This enables a faster changeover from a wiping operation into a regeneration operation of the wet-cleaning device. The same also applies to changing over from a regeneration operation into a wiping operation, wherein the two cover elements are also displaced out of the opening region in opposite directions simultaneously. Specifically, for example, this means that the first cover element for covering the opening region can be displaced around the cleaning roller counterclockwise, while the second cover element for covering the opening region can be displaced clockwise. The same holds true conversely with regard to changing from the regeneration operation into the wiping operation, during which the opening region is released.

For example, the cover elements can each be designed as a quadrant section, so that these together cover half the circumference of the cleaning roller. Correspondingly thereto, the roller cover can further have a semicircular area fixedly formed on the housing of the wet-cleaning device, which additionally covers the cleaning roller in combination with the displaceable cover elements, thereby enabling a complete enclosure in the circumferential direction. Since the two cover elements are symmetrically designed relative to the roller axis, the semicircular area of the housing and the cover elements can together yield a circular roller cover. The circular shape of the roller cover here makes it possible to optimally transport away the liquid or dirt inside of the roller cover. In addition, the circular shape is also associated with a significantly lower manufacturing outlay than a freeform surface, for example.

In addition, it is proposed that the displaceable cover elements be coupled by a gearbox with the cleaning roller, in particular the roller axis, in such a way that the cover elements can be displaced by moving the cleaning roller and vice versa. This configuration makes it possible to simultaneously displace the cover elements relative to the opening region of the roller cover and displace the cleaning roller out of or into the housing of the wet-cleaning device. For example, during the wiping operation, the cover elements are located outside of the opening region, while a partial circumferential area of the cleaning roller protrudes out of the housing of the wet-cleaning device, specifically through the opening region of the roller cover. For example, in order to get from the wiping operation into the regeneration operation, the cleaning roller is lifted from the surface to be cleaned, and thus also displaced relative to the housing of the wet-cleaning device. As a result, the gearbox simultaneously causes the cover elements to be displaced in the direction of the opening region, so that the cleaning roller at the beginning of the regeneration operation is already covered by a corresponding partial area of the housing on the one hand and by the two cover elements on the other. The displacement of the cover elements and displacement of the cleaning roller are thus coupled with each other. Consequently, a user of the wet-cleaning device must at most initiate only one of the displacements, specifically either the displacement of the cleaning roller or the displacement of the cover elements, for example by activating a switch.

Alternatively, the displacements, i.e., initially one of the displacements, can also be initiated automatically, for example by means of sensors and a controller, for example which detect the degree of contamination of the cleaning roller and thereupon automatically initiate a regeneration operation. The displacement from the wiping operation into the regeneration operation or from the regeneration operation into the wiping operation can thus be accomplished in an especially comfortable and also time-saving manner.

In addition, it is proposed that the gearbox have a slotted cover guide formed in a housing of the wet-cleaning device, into which engaging elements arranged on the cover elements engage. Given a displacement of the cleaning roller, the engaging elements of the cover elements are guided into the slotted cover guide, so that the roller cover either opens or closes, depending on the direction of displacement of the cleaning roller. For example, the slotted cover guide can have a guide groove, into which the engaging element or engaging elements can be shifted. An earlier or later closure of the opening region relative to the displacement of the cleaning roller can be controlled, depending on the configuration of the shape of the slotted cover guide, in particular a slope. For example, proceeding from a direction of displacement from a wiping operation into a regeneration operation, the slotted cover guide can initially have a relatively flat progression, and then a steeper progression by comparison thereto, in order to chronologically end the closure of the roller cover before the cleaning roller has reached its final position for the regeneration operation. Such a configuration is especially advantageous so as to be able to provide as circular a shape as possible for the closed roller cover. As an alternative to the proposed design of the gearbox as a slotted guide, the gearbox can of course be designed differently, for example taking the form of a toothed gearing, which transfers a displacement of the cleaning roller to the cover elements, or transfers a displacement of the cover elements to the cleaning roller.

With respect to the slotted cover guide, it is proposed that the latter have a first partial slotted guide, into which an engaging element of the first cover element engages, and a second partial slotted guide, into which an engaging element of the second cover element engages. The slotted cover guide thus has two in particular separately designed partial slotted guides for the first cover element on the one hand and the second cover element on the other. As a result, the partial slotted guides can advantageously have end stops for the respective engaging element, which define the end positions of the respective cover element in relation to the wiping operation or regeneration operation. Care must here be taken to prevent the partial slotted guides of the cover elements from crossing as viewed in the longitudinal extension of the cleaning roller, so that the displacements of the cover elements do not impede each other. This can be achieved by correspondingly arranging the partial slotted guides on the housing of the wet-cleaning device and correspondingly placing the engaging elements on the cover elements.

In addition, it is proposed that the cover elements can be displaced in the circumferential direction of the cleaning roller around a shared covering axis, in particular rotated around the roller axis. This embodiment is suitable in particular for achieving a symmetrical arrangement of the cover elements relative to the cleaning roller, and hence the best possible liquid or dirt transport out of the roller cover. In addition, this yields a smallest possible structural design for the roller cover, and hence also for the housing of the wet-cleaning device. Furthermore, when displacing the cleaning roller into the housing or out of the housing, this makes it especially easy to also automatically displace the cover elements in a corresponding direction—and this in addition to displacing the cover elements in the circumferential direction of the cleaning roller. Another advantage is that the displaced cleaning roller, in particular the displaced roller axis, can thus not collide with the covering axis.

It is proposed that the cleaning roller be displaceable by means of a displacement drive relative to a housing of the wet-cleaning device. It is here proposed in particular that the roller axis be arranged on a swiveling arm mounted on the housing of the wet-cleaning device so that it can pivot around a swiveling axis. For example, the displacement drive can be an electric motor, a solenoid or the like. In this embodiment, the user of the wet-cleaning device need not perform any manual displacement of the cleaning roller. For example, it is here instead enough to activate a switch for operating the displacement drive. However, as explained before, the displacement drive can alternatively also be fully automated via sensors and a controller. In particular, the roller axis has allocated to it a swiveling arm, which connects the roller axis with the housing of the wet-cleaning device. This swiveling arm can either be pivoted manually by the user of the wet-cleaning device, or automatically by the proposed displacement drive. As a consequence, the roller axis, and hence also the cleaning roller, are displaced along a curved path, which essentially has a radius corresponding to the length of the swiveling arm. The swiveling arm carries the roller axis, which is preferably oriented parallel to the swiveling axis, and thus is displaced around the swiveling axis of the swiveling arm while the swiveling arm is pivoted along a circular path. Depending on the length of the swiveling arm and the position of the roller axis on the swiveling arm, a lever that determines the force required for displacing the roller axis can be varied.

The housing here advantageously has a slotted roller guide for guiding the cleaning roller during a displacement. The slotted roller guide can in turn be designed as a guiding groove inside of the housing, into which a partial area of the cleaning roller, in particular a partial area of the roller axis, engages. For example, an end-side partial area of the roller axis connected with the swiveling arm for displacing the cleaning roller can preferably engage into the slotted roller guide, and there be guided along a circular section during its displacement motion.

A first variant here proposes that the slotted roller guide and slotted cover guide be allocated to mutually opposing front sides of the cleaning roller. In this variant, the slotted roller guide is allocated to a first front side of the cleaning roller, and the slotted cover guide is allocated to the opposing second front side of the cleaning roller, so that the slotted guides are formed on partial areas of the housing of the wet-cleaning device that are adjacent to different front sides of the cleaning roller. As a result, the slotted roller guide and slotted cover guide do not overlap each other in the same plane, which otherwise could result in an uncertainty of the displacement motion of the cover elements and/or cleaning roller in the overlapping area.

A second variant alternatively proposes that the slotted roller guide and slotted cover guide be allocated to the same front side of the cleaning roller, wherein the slotted cover guide, in particular a partial slotted guide, has allocated to it an auxiliary slotted guide, which as viewed in the longitudinal extension of the cleaning roller is designed in particular to provide a one-to-one guiding direction for the cover element or cover elements given an overlapping of the slotted roller guide and slotted cover guide. In this variant, it is in particular also possible to provide both a slotted roller guide and a slotted cover guide in the area of both front sides of the cleaning roller, which is advantageous in particular to achieve a uniform displacement progression of the cleaning roller and/or cover elements and prevent tilting during displacement. Since simultaneously arranging a slotted roller guide and a slotted cover guide on the same partial area of the housing (specifically in the same plane) causes the slotted guides to overlap, a resultant undefined nature of the displacement motion inside of the overlapping area is compensated by the arrangement of the auxiliary slotted guide. The auxiliary slotted guide must here only be allocated to such a partial slotted guide that overlaps the slotted roller guide. By contrast, a partial slotted guide that does not overlap the slotted roller guide does not require the allocation of an auxiliary slotted guide. As long as the engaging element of the slotted cover guide is still located in a guiding area of the partial slotted guide that has no overlap with the slotted roller guide, the displacement motion of the cover element—and also the displacement of the cleaning roller—is still clearly defined. The auxiliary slotted guide can have an expansion relative to this area, which is exaggerated by comparison to an engaging element of the cover element that engages into the auxiliary slotted guide, so that the engaging element does not abut against the partial slotted guide, and the engaging element is thus not guided by the auxiliary slotted guide. This not least prevents an overdetermined displacement of the cover elements. In a guiding area of the slotted cover guide that crosses the slotted roller guide, the slotted cover guide has allocated to it the auxiliary slotted guide with a second guiding area, which is tapered relative to the aforementioned expanded guiding area. As a result of the tapered configuration of this guiding area, the engaging element of the respective cover element now abuts against the auxiliary slotted guide, and can be guided through the latter. This allows the engaging element of the cover element to be displaced along a one-to-one displacement path, even through the slotted roller guide.

Apart from the wet-cleaning device described above, the invention also proposes a method for operating a wet-cleaning device, in particular for operating a wet-cleaning device described above, wherein a rotatable cleaning roller is displaced away from a surface to be cleaned for a regeneration operation of the cleaning roller, and wherein at least one displaceable cover element is displaced into an opening region of a roller cover that at least partially envelops the cleaning roller in the circumferential direction, and wherein a first cover element and a second cover element are displaced oppositely toward each other relative to a circumferential direction of the cleaning roller, so as to close and/or open the opening region from opposite circumferential directions. The resultantly achieved advantages are similar to the ones described above in relation to the wet-cleaning device. In particular, it is here also proposed that the displaceable cover elements be coupled with the cleaning roller by way of a gearbox in such a way that the cover elements are displaced via a displacement of the cleaning roller, and vice versa. In particular, the gearbox can have a slotted cover guide formed in a housing of the wet-cleaning device, into which engaging elements arranged on the cover elements engage. In addition, the cover elements and cleaning roller are displaced by means of the slotted cover guide and/or the slotted roller guide and/or the auxiliary slotted guide as described above.

Within the meaning of the invention, wet-cleaning devices are basically to be understood as all those devices that can perform a wet cleaning, whether exclusively or among other operations. These involve the hand guided and automatically traversable wet-cleaning devices on the one hand, to include in particular cleaning robots, and also combined drying and wet-cleaning devices on the other. Also intended within the meaning of the invention apart from the usual floor cleaning devices for cleaning a floor are wet-cleaning devices for cleaning above-floor surfaces. For example, these include devices for cleaning windows and the like.

BRIEF DESCRIPTION OF THE DRAWINGS

The invention will be explained in greater detail below based on exemplary embodiments. Shown on.

DESCRIPTION OF THE EMBODIMENTS

Figure 1:
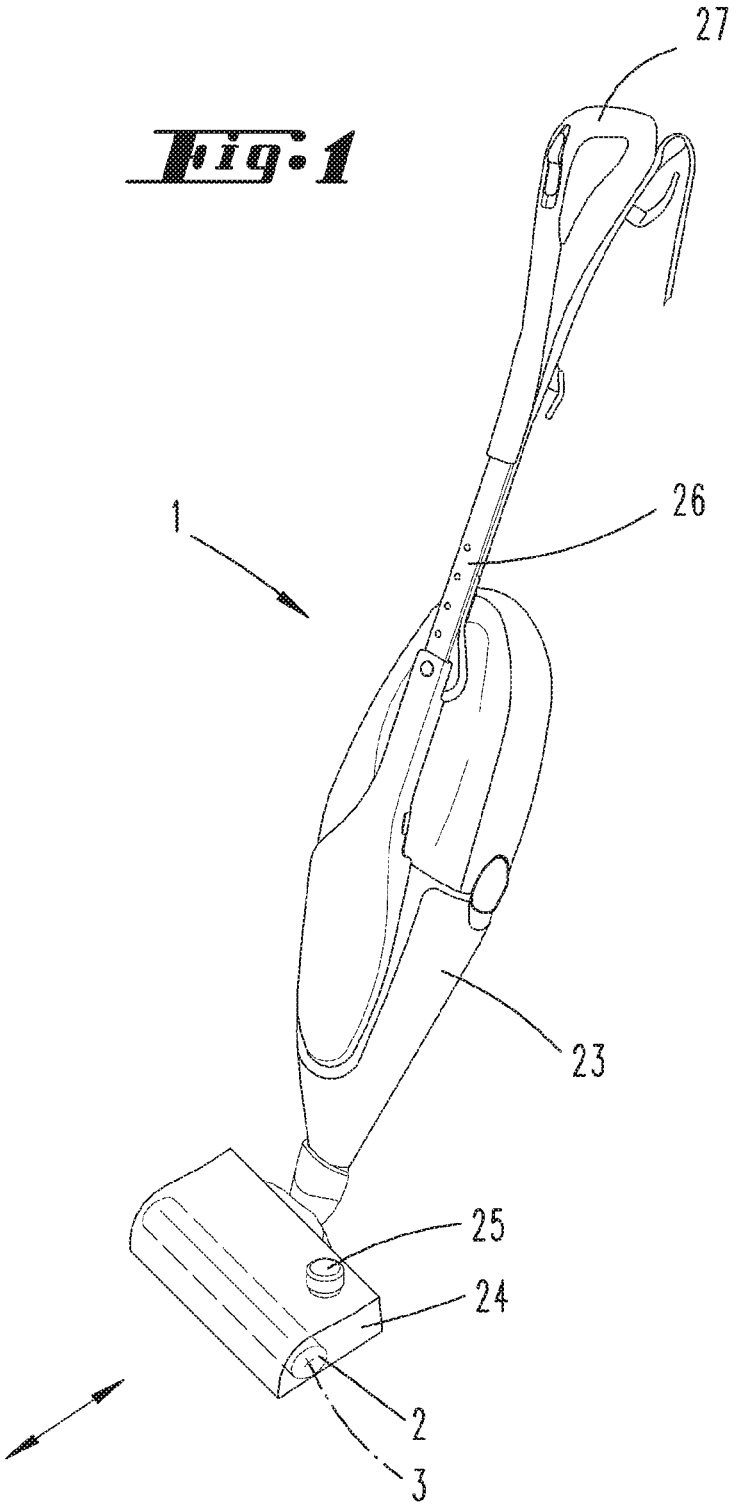
FIG. 1 is a wet-cleaning device according to the invention.

FIG. 1 shows a wet-cleaning device 1, which is here designed as a wet wiping device with a base unit 23 and an attachment 24. Arranged on the base unit 23 is a stalk 26 with a handle 27, by means of which a user can guide the wet-cleaning device 1 over a surface to be cleaned. The stalk 26 is here advantageously telescoping in design, so that a user can adjust the height of the wet-cleaning device to his or her height. During a conventional wiping operation, the user displaces the wet-cleaning device 1 in a forward and backward motion over the surface to be cleaned, alternately pushing the wet-cleaning device 1 away and pulling it back.

The attachment 24 has a housing 17, in which is arranged a tank (not shown) for cleaning liquid, for example water. Cleaning liquid can be filled into the tank via a filler neck 25. Also arranged in the housing 17 is a cleaning roller 2, which can be rotated around a roller axis 3. The roller axis 3 is essentially perpendicular to a conventional direction of movement of the wet-cleaning device 1, in which the user alternately pushes the wet-cleaning device 1 away and pulls it back in.

The cleaning liquid can be dispensed from the tank onto the surface of the cleaning roller so as to moisten the latter.

During a wiping operation of the wet-cleaning device 1, the cleaning roller 2 rotates around the roller axis 3, so that the circumferential surface of the cleaning roller 2 continuously rolls onto the surface to be cleaned. The cleaning roller 2 is usually wound with a cleaning pad, possibly with an additional liquid-storing sponge body interspersed. For example, the cleaning pad is here a textile cleaning cloth. During the wiping operation, dirt continuously gathers on the cleaning roller 2, i.e., on the cleaning pad. For this reason, it may be necessary to regenerate the cleaning roller 2 after a certain operating period, wherein dirt and liquid loaded with dirt are removed from the cleaning roller 2 during a regeneration operation. To this end, the cleaning roller 2 is usually rotated at a speed that is higher than the speed of the cleaning roller 2 during the wiping operation. This causes dirt and liquid loaded with dirt to be spun away from the cleaning roller 2. The sprayed liquid can be collected and relayed to a collecting tank.

Figure 2:
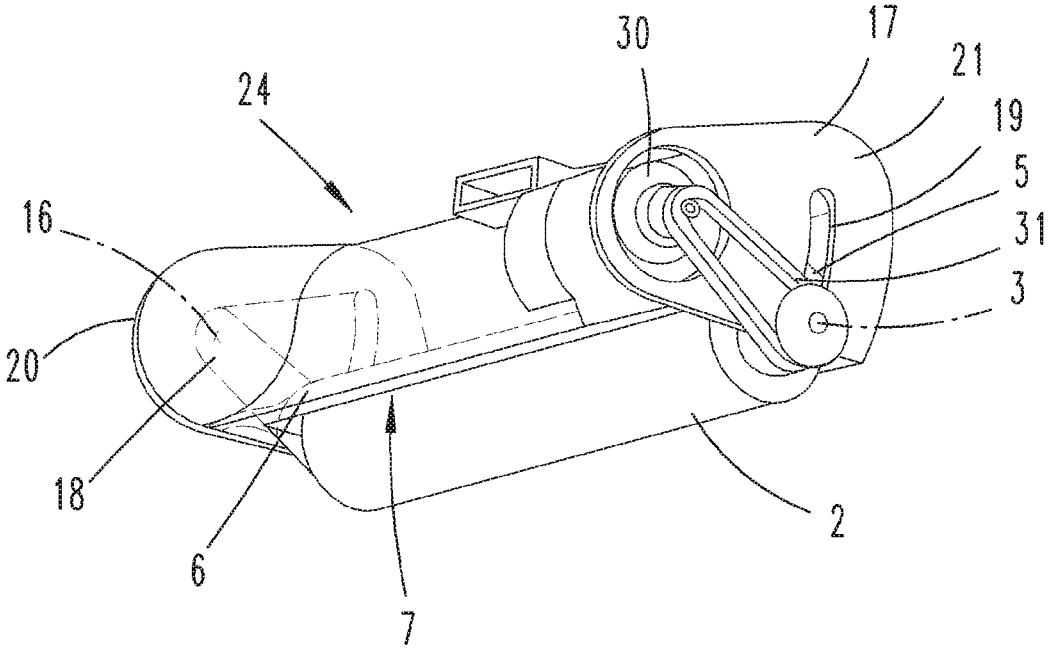
FIG. 2 is a perspective view of a partial area of the wet-cleaning device during a wiping operation.

FIG. 2 presents a perspective view of a partial area of the attachment 24, in which the cleaning roller 2 is held so that it can rotate around the roller axis 3. The position of the cleaning roller 2 here corresponds to the position during a wiping operation of the wet-cleaning device 1. The roller axis 3 is connected with a motor 30 via a drive belt 31, so that the cleaning roller 2 can be rotatably driven during the wiping operation. In addition, the roller axis 3 is mounted to the housing 17 of the wet-cleaning device so that it can be pivoted around a swiveling axis 16 via a swiveling arm 18. A swiveling motion of the swiveling arm 18 around the swiveling axis 16 makes it possible to displace the roller axis 3, and thus also the cleaning roller 2, from the position shown on FIG. 2 during the wiping operation into the position shown on FIG. 3 during a regeneration operation. To this end, the swiveling axis 16 can also have allocated to it a drive, for example an electric motor.

The attachment 24 has a roller cover 4, one part of which is immovably fixed to the housing 17, and the other part of which has two displaceable cover elements 5, 6, which in the illustration on FIG. 2 are displaced over the cleaning roller 2, and thus mostly covered by the latter. The cover elements 5, 6 can be displaced around a cover axis 14, wherein the cover axis 14 here simultaneously corresponds to the roller axis 3. The cover elements 5, 6 correspond to the immovably fixed part of the roller cover 4 in such a way that the latter can optionally close and open an opening region 7 of the roller cover 4. As has yet to be explained later, the cover elements 5, 6 can for this purpose be displaced opposite one another into the opening region 7 relative to a circumferential direction of the cleaning roller 2, so that the opening region 7 can be closed or opened from opposite circumferential directions. In the area of the front sides 20, 21 of the cleaning roller 2, the housing 17 of the attachment 24 also has slotted guides for the cleaning roller 2 and the cover elements 5, 6, which guide the displacement motions given a change from a wiping operation to a regeneration operation and vice versa. As will be explained in greater detail with reference to the following figures, these include a slotted cover guide 9 for the cover elements 5, 6 and a slotted roller guide 19 for the roller axis 3 of the cleaning roller 2.

Figure 3:
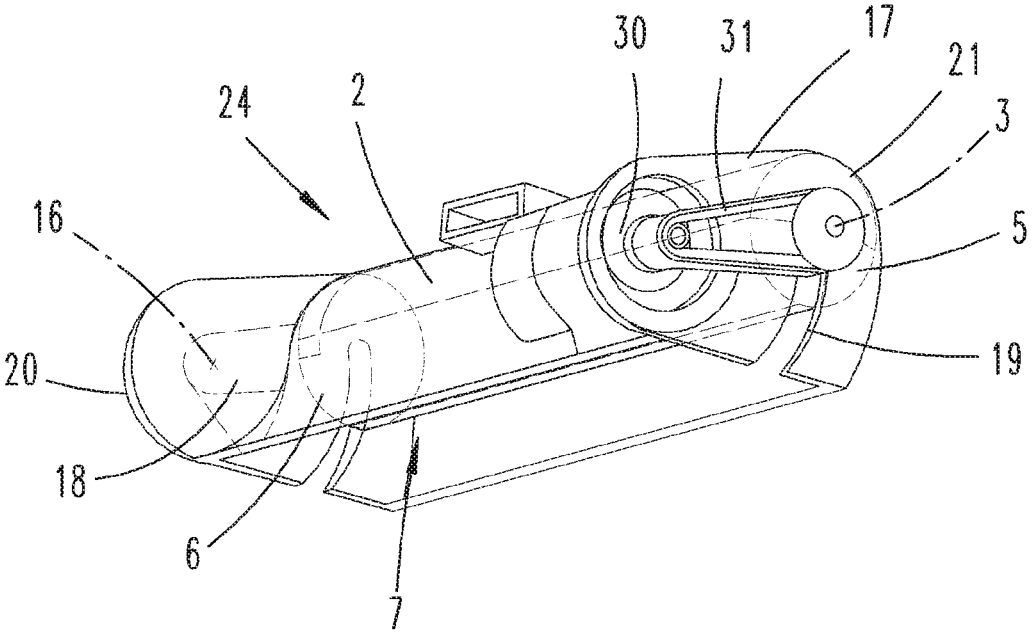
FIG. 3 is the partial area according to FIG. 2 during a regeneration operation.

FIG. 3 shows the partial area of the attachment 24 during a regeneration operation. The cleaning roller 2 is here pivoted into the housing 17 of the wet-cleaning device 1 by means of the swiveling arm 18, and the cover elements 5, 6 are displaced into the opening region 7 of the roller cover 4, so that the immovably fixed partial area of the roller cover 4 and the displaceable cover elements 5, 6 together form a roller cover 4 that is completely closed in the circumferential direction of the cleaning roller 2.

Figure 4:
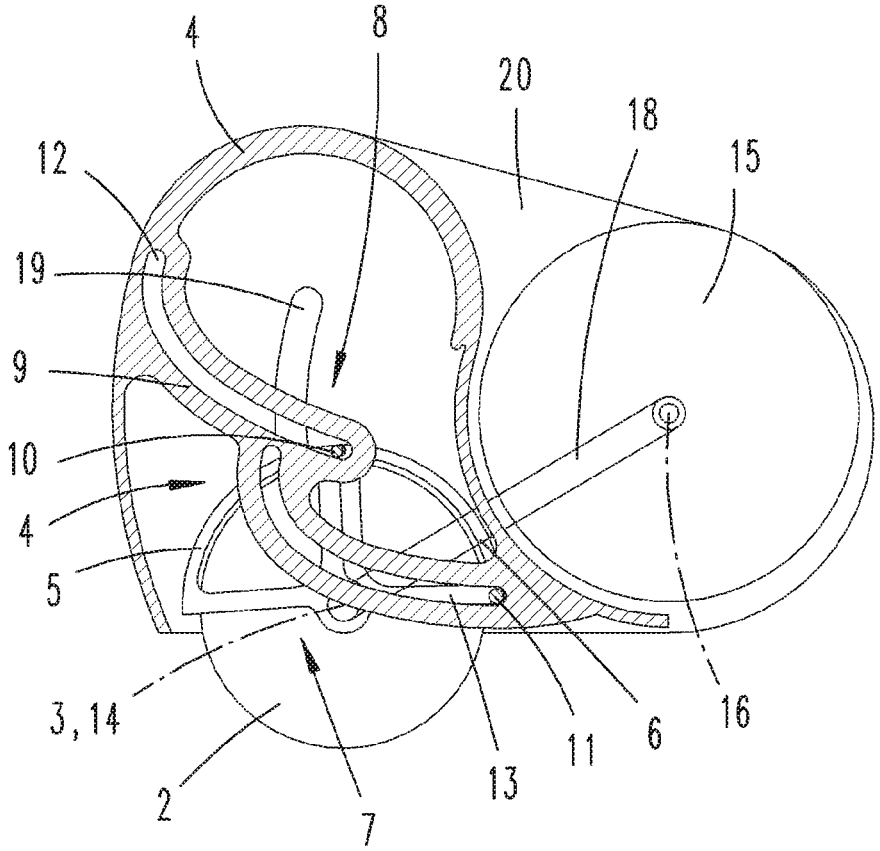
FIG. 4 is a cross sectional view of a partial area according to a first embodiment during a wiping operation.
Figure 5:
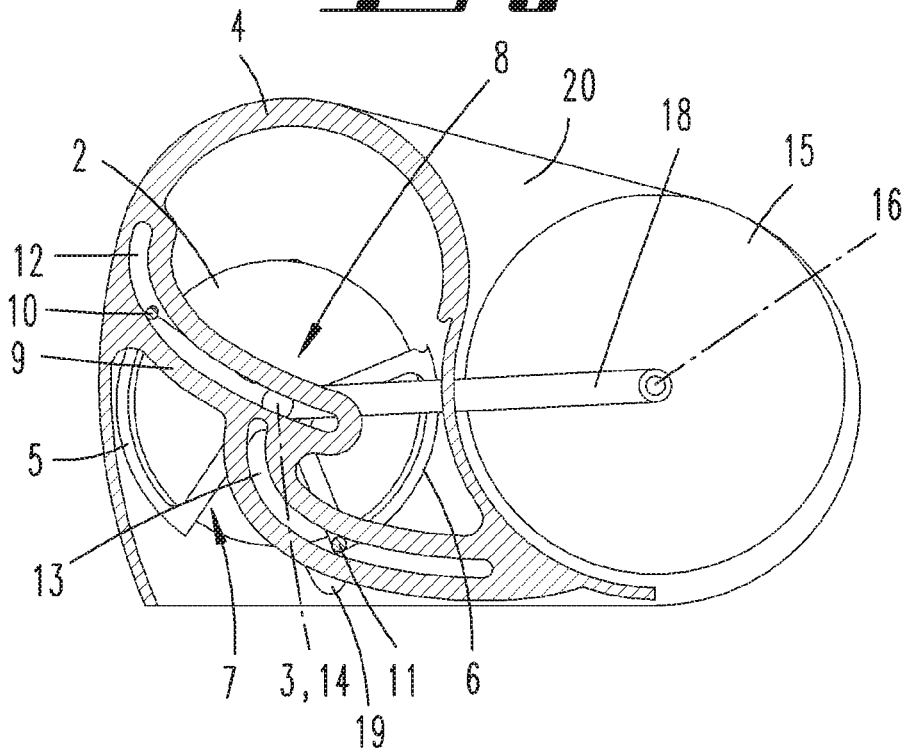
FIG. 5 is the partial area according to FIG. 4 in an intermediate position.
Figure 6:
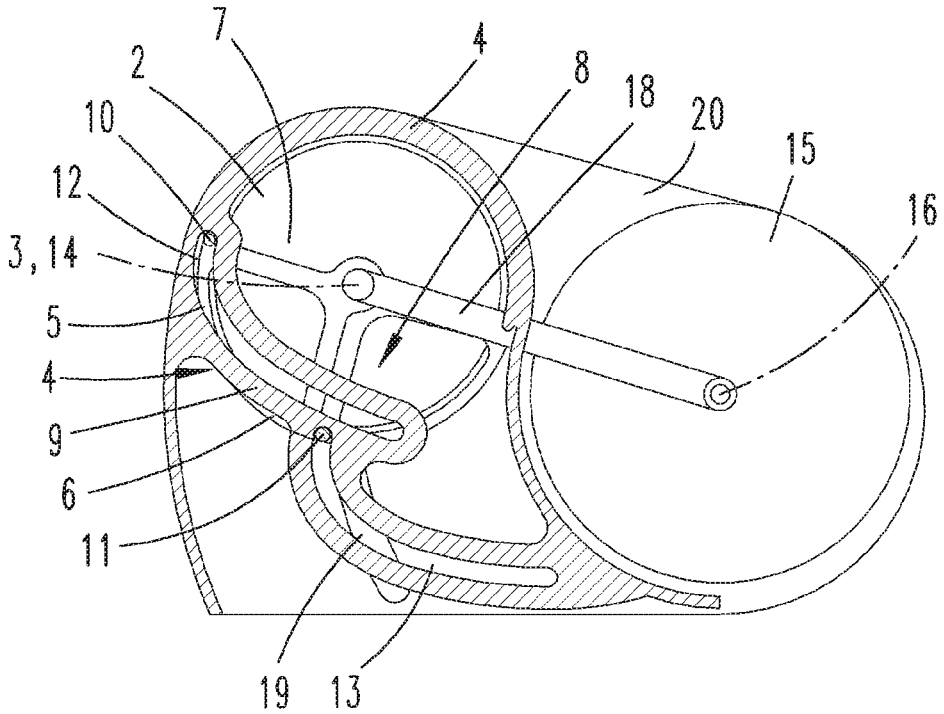
FIG. 6 is the partial area according to FIGS. 4 and 5 during a regeneration operation.

FIGS. 4 to 6 show a first embodiment variant of the invention, in which the housing 17 of the attachment 24 has a slotted roller guide 19 on the one hand and a slotted cover guide 9 on the other in the area of opposing front sides 20, 21 of the cleaning roller 2. Specifically, a slotted cover guide 9 is arranged in the area of the front side 20 facing toward the front in the illustration to guide the displacement motion of the cover elements 5, 6, i.e., on the side of the housing 17 corresponding to the top view on the figure. In the area of the front side 21 lying opposite the front side 20, the slotted roller guide 19 for guiding the displacement motion of the roller axis 3 is arranged on the housing 17, which as shown on the figure lies on the rear side of the depicted partial area of the wet-cleaning device 1. As a consequence, the view corresponds to a view of the housing 17 from the left in relation to FIGS. 2 and 3.

FIG. 4 shows the cleaning roller 2 in a position displaced onto a surface to be cleaned, as well as the roller cover 4 with the displaceable cover elements 5, 6, which here are pivoted out of the opening region 7 of the roller cover and are located behind the cleaning roller 2 as viewed in the direction proceeding from the surface to be cleaned. The roller axis 3 is displaced around the swiveling axis 16 in the direction of the surface to be cleaned via the swiveling arm 18. The swiveling axis 16 has allocated to it a displacement drive 15, for example which here is an electric motor. The cover elements 5, 6 cover a respective quadrant section in the circumferential direction of the cleaning roller 2, i.e., each covers an angular range of 90 degrees. In the direction of the roller axis 3, the cover elements 5, 6 are formed along the entire longitudinal extension of the cleaning roller 2. The cover elements 5, 6 can be pivoted around the cover axis 14, which simultaneously is the roller axis 3. In the area of the (rear) front side 21 of the cleaning roller 3, the roller axis 3 is guided in the slotted roller guide 19, which has a curvature that essentially corresponds to the swiveling radius of the swiveling arm 18 around the swiveling axis 16. In the area of the front side 20 lying opposite the slotted roller guide 19, the housing 17 has a slotted cover guide 9, which forms a gearbox 8 for coupling the displacement motion of the cleaning roller 2 with a displacement motion of the cover elements 5, 6. The slotted cover guide 9 has two partial slotted guides 12, 13, which each have a guiding groove. An engaging element 10 of the first cover element 5 engages into the partial slotted guide 12, while an engaging element 11 of the second cover element 6 engages into the partial slotted guide 13. The engaging elements 10, 11 are designed like sliding blocks.

Proceeding from the wiping operation shown on FIG. 4, the displacement of the cleaning roller 2 into the housing 17 and the encapsulation of the cleaning roller 2 by means of the cover elements 5, 6 for the regeneration operation of the wet-cleaning device 1 shown on FIG. 6 take place in such a way that the swiveling arm 18 is first pivoted clockwise around the swiveling axis 16 by means of the displacement drive 15. As a result, the end area of the swiveling arm 18 carrying the roller axis 3 is displaced further into the housing 17, so that the cleaning roller 2 is simultaneously also swiveled into the housing 17. The displacement motion of the roller axis 3 is guided by the slotted roller guide 19. Due to the displacement of the roller axis 3, which simultaneously corresponds to the cover axis 14 for the cover elements 5, 6, the engaging elements 10, 11 of the cover elements wander upward toward the left inside of the partial slotted guides 12, 13 relative to the illustration on the figure (see intermediate position according to FIG. 5). This causes the cover elements 5, 6 to pivot around the cover axis 14, wherein the cover elements 5, 6 are displaced into the opening region 7 of the roller cover 4 in mutually opposite circumferential directions in relation to the circumferential direction of the cleaning roller 2. As the roller axis 3 is further displaced proceeding from FIG. 5, the roller axis 3 reaches the final position according to FIG. 6 prescribed by the slotted roller guide 19, which corresponds to the position during the regeneration operation of the wet-cleaning device 1. The cover elements 5, 6 are completely displaced into the opening region 7 of the roller cover 4, and the engaging elements 10, 11 have reached an end stop prescribed by the partial slotted guides 12, 13. In this position, the regeneration operation of the wet-cleaning device 1 can be started, wherein the cleaning roller 2 is rotated at a high speed, for example of greater than 2,000 RPM (at an exemplary roller diameter of 45 mm), and dirty liquid inside of the roller cover 4 located on the cleaning roller 2 can be spun away and relayed to a collecting tank.

The change from the regeneration operation to a wiping operation of the wet-cleaning device 1 then takes place in the reverse sequence, wherein the swiveling arm 18 is then first displaced once again by means of the displacement drive 15, specifically relative to the usual orientation of the wet-cleaning device 1, toward the surface to be cleaned. The gearbox 8 is used to simultaneously pivot the cover elements 5, 6 out of the opening region 7 of the roller cover 4 again, so that the cleaning roller 2 comes to lie on the surface to be cleaned. The shape, in particular the pitch, of the partial slotted guides 12, 13 of the slotted cover guide 9 makes it possible to prescribe a chronological progression between the displacement of the cleaning roller 2 and displacement of the cover elements 5, 6. For example, because the pitch of the partial slotted guides 12, 13 is initially relatively slight (proceeding from the wiping operation), the cover elements 5, 6 can first be displaced completely into the opening region 7 before the cleaning roller 2 reaches the end position for the regeneration operation.

Figure 7:
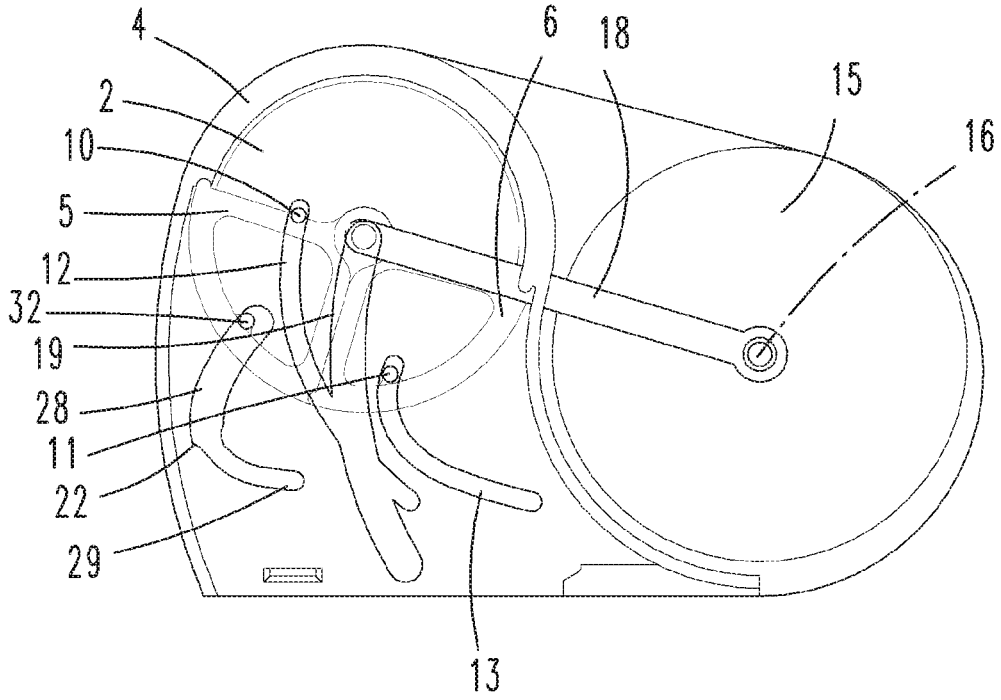
FIG. 7 is a cross sectional view of a partial area according to a second embodiment of a wet-cleaning device during a regeneration operation.
Figure 8:
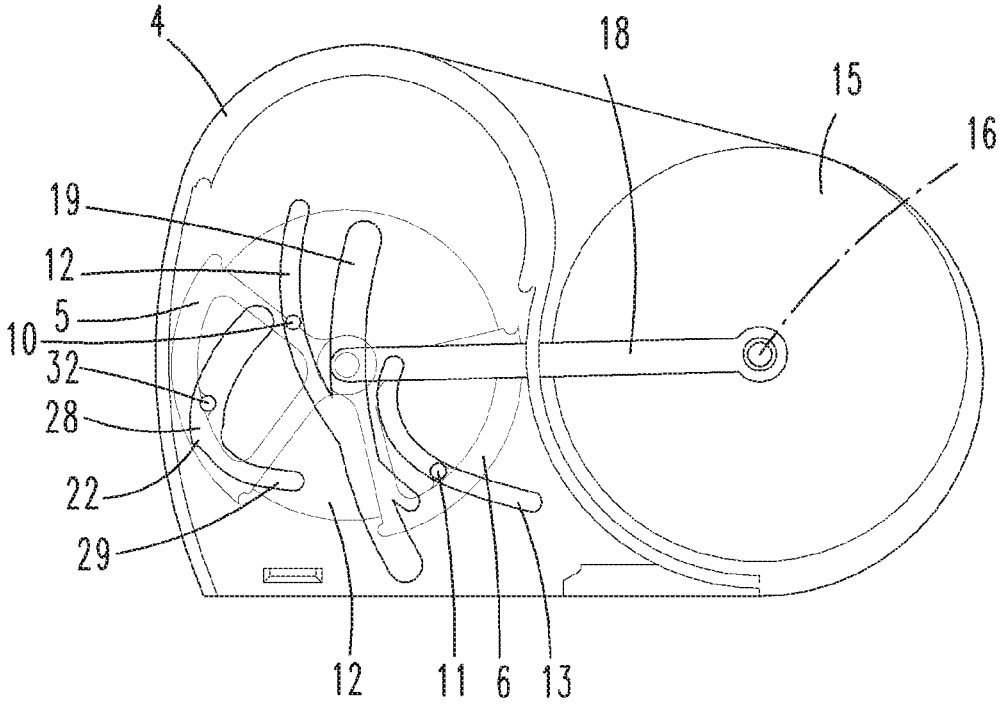
FIG. 8 is the partial area according to FIG. 7 in an intermediate position.
Figure 9:
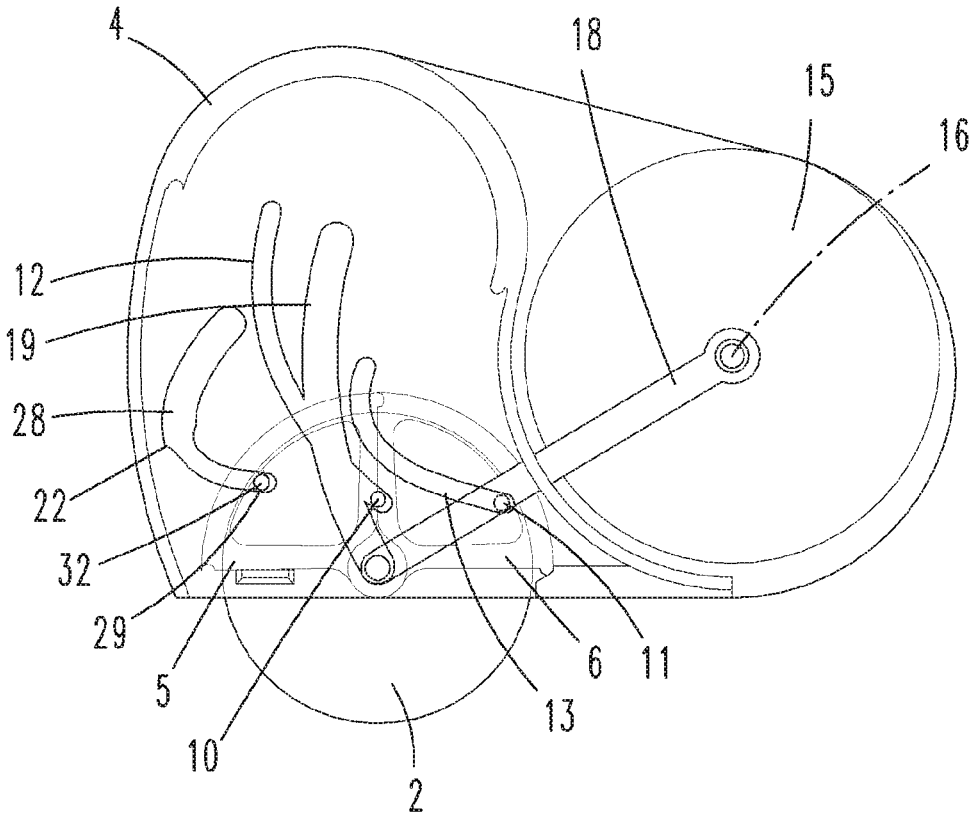
FIG. 9 is the partial area according to FIGS. 7 and 8 during a wiping operation.

FIGS. 7 to 9 show a second embodiment variant of the invention, in which both a slotted cover guide 9 and a slotted roller guide 19 are formed on the housing in the area of both front sides 20, 21 of the cleaning roller 2. This is advantageous in particular to achieve a uniform displacement motion of the cleaning roller 2 and cover elements 5, 6, as well as to prevent tilting during the displacement motions. In this embodiment, however, the slotted roller guide 19 comes to overlap the slotted cover guide 9 as viewed in the direction of longitudinal extension of the cleaning roller 2. Therefore, in order to avoid any uncertainty with respect to displacement motion in the area where the slotted roller guide 19 and slotted cover guide 9 overlap, the housing 17 also has an auxiliary slotted guide 22 in the area of at least one of the front sides 20, 21, into which an additional engaging element 32 of the cover element 5 engages, the partial slotted guide 12 of which overlaps with the slotted roller guide 19 (as viewed in the direction of longitudinal extension of the cleaning roller 2). Such an auxiliary slotted guide 22 is not necessary for the partial slotted guide 13, since the partial slotted guide 13 has no overlap with the slotted roller guide 19.

The auxiliary slotted guide 22 has two guiding areas 28, 29, of which a first guiding area 28 has a larger width than a second guiding area 29. As a result, the engaging element 32 in the guiding area 28 is not guided by the auxiliary slotted guide 22, so that the displacement of the cover element 5 in this area is only guided by the partial slotted guide 12 of the slotted cover guide 9. By contrast, in the area where the slotted cover guide 9 overlaps with the slotted roller guide 19, the engaging element 32 is guided by the guiding area 29, so that the engaging element 10 can run through the overlapping area in a one-to-one displacement direction.

The displacements of the cleaning roller 2 and cover elements 5, 6 from a regeneration operation into a wiping operation take place correspondingly in the reversed direction. Otherwise, the displacement progressions described with respect to the first embodiment variant apply accordingly, which are initiated by displacing the swiveling arm 18 and simultaneously initiate the displacements of the cleaning roller 2 and cover elements 5, 6.

| Reference List | |
|---|---|
| 1 | Wet-cleaning device |
| 2 | Cleaning roller |
| 3 | Roller axis |
| 4 | roller cover |
| 5 | Cover element |
| 6 | Cover element |
| 7 | Opening region |
| 8 | Gearbox |
| 9 | Slotted cover guide |
| 10 | Engaging element |
| 11 | Engaging element |
| 12 | Partial slotted guide |
| 13 | Partial slotted guide |
| 14 | Cover axis |
| 15 | Displacement drive |
| 16 | Swiveling axis |
| 17 | Housing |
| 18 | Swiveling arm |
| 19 | Slotted roller guide |
| 20 | Front side |
| 21 | Front side |
| 22 | Auxiliary slotted guide |
| 23 | Base unit |
| 24 | Attachment |
| 25 | Filler neck |
| 26 | Stalk |
| 27 | Handle |
| 28 | Guiding area |
| 29 | Guiding area |
| 30 | Motor |
| 31 | Drive belt |
| 32 | Engaging element |

The invention claimed is:

1. A wet-cleaning device (1), in particular a wet wiping device, with a cleaning roller (2) mounted rotatably around a roller axis (3) and a roller cover (4) enveloping the cleaning roller (2) at least partially in a circumferential direction, which has at least one displaceable cover element (5, 6) for optionally closing and/or releasing an opening region (7) of the roller cover (4), wherein the wet-cleaning device (1) has a first cover element (5) and a second cover element (6), which can be displaced in opposition to each other in the circumferential direction of the cleaning roller (2), so as to close and/or release the opening region (7) from opposite circumferential directions, wherein the first cover element (5) and the second cover element (6) are mounted rotatably around a common cover axis (14) that simultaneously corresponds to the roller axis (3).

2. The wet-cleaning device (1) according to claim 1, wherein the displaceable cover elements (5, 6) are coupled by a gearbox (8) with the cleaning roller (2), in particular the roller axis (3), in such a way that the cover elements (5, 6) can be displaced by moving the cleaning roller (2) and vice versa.

3. The wet-cleaning device (1) according to claim 2, wherein the gearbox (8) has a slotted cover guide (9) formed in a housing of the wet-cleaning device (1), into which engaging elements (10, 11) arranged on the cover elements (5, 6) engage.

4. The wet-cleaning device (1) according to claim 3, wherein the slotted cover guide (9) has a first partial slotted guide (12), into which an engaging element (10) of the first cover element (5) engages, and a second partial slotted guide (13), into which an engaging element (11) of the second cover element (6) engages.

5. The wet-cleaning device (1) according to claim 1, wherein the cleaning roller (2) is displaceable by means of a displacement drive (15) relative to a housing (17) of the wet-cleaning device (1), wherein the roller axis (3) is arranged on a swiveling arm (18) mounted on the housing (17) of the wet-cleaning device (1) so that the swiveling arm can pivot around a swiveling axis (16).

6. The wet-cleaning device (1) according to claim 5, wherein the housing (17) has a slotted roller guide (19) for guiding the cleaning roller (2) during a displacement.

7. The wet-cleaning device (1) according to claim 6, wherein the slotted roller guide (19) and slotted cover guide (9) are allocated to mutually opposing front sides (20, 21) of the cleaning roller (2).

8. The wet-cleaning device (1) according to claim 6, wherein the slotted roller guide (19) and slotted cover guide (9) are allocated to the same front side (20, 21) of the cleaning roller (2), wherein an auxiliary slotted guide (22) is allocated to the slotted cover guide (9), wherein the auxiliary slotted guide (22), as viewed in the longitudinal extension of the cleaning roller (2) is designed to provide a one-to-one guiding direction for the cover element (5, 6) or cover elements (5, 6) given an overlapping of the slotted roller guide (19) and slotted cover guide (9).

9. A method for operating a wet-cleaning device (1), in particular for operating a wet-cleaning device (1) according to claim 1, wherein a rotatable cleaning roller (2) is displaced away from a surface to be cleaned for a regeneration operation of the cleaning roller (2), and wherein at least one displaceable cover element (5, 6) is displaced into an opening region (7) of a roller cover (4) that at least partially envelops the cleaning roller (2) in a circumferential direction, wherein a first cover element (5) and a second cover element (6) can be displaced in opposition to each other in the circumferential direction of the cleaning roller (2), so as to close and/or release the opening region (7) from opposite circumferential directions, wherein the first cover element (5) and the second cover element (6) are mounted rotatably around a common cover axis (12) that simultaneously corresponds to the roller axis (3).

* * * * *